US005290211A

United States Patent [19]

Stearns

[11] Patent Number: 5,290,211

[45] Date of Patent: Mar. 1, 1994

[54] EXERCISE DEVICE

[75] Inventor: Kenneth W. Stearns, Houston, Tex.

[73] Assignee: Stearns Technologies, Inc., Houston, Tex.

[21] Appl. No.: 968,196

[22] Filed: Oct. 29, 1992

[51] Int. Cl.[5] ..... A63B 22/00

[52] U.S. Cl. ..... 482/53; 482/70; 482/51

[58] Field of Search ..... 482/51, 52, 53, 54, 482/74, 70, 71, 148; 128/25 R

[56] References Cited

U.S. PATENT DOCUMENTS

| | | | |
|---|---|---|---|
| 3,316,898 | 5/1967 | Brown | 128/25 R |
| 3,756,595 | 9/1973 | Hague | 482/51 |
| 4,720,093 | 1/1988 | Delmar | 482/52 |
| 5,078,389 | 1/1992 | Chen | 482/53 |
| 5,195,935 | 3/1993 | Fencel | 482/52 |

*Primary Examiner*—Stephen R. Crow

*Attorney, Agent, or Firm*—Bush, Moseley & Riddle

[57] ABSTRACT

An exercise device (10) has foot supports (30, 32) on which a user stands for performing a stair stepping exercise alone, or a cross country skiing exercise alone, or simultaneously a stair stepping exercise and a cross country skiing exercise. Linkage support frames (26, 28) each have a first linkage (44) and a second linkage (36) pivotally connected to each other for maintaining foot supports (30, 32) in a horizontal plane. A fluid cylinder (52) provides a mechanism for resisting the vertical movement of the foot supports (30, 32). Manually gripped poles (60) are mounted to move in coordination with generally horizontal movement of foot supports (30, 32). Separate embodiments of the invention are shown in FIGS. 5-13 for performing simultaneously a stair stepping exercise and a cross country skiing or walking exercise. An alternative preferred embodiment of the invention which may be folded downwardly for low vertical profile storage is illustrated in FIG. 14.

30 Claims, 6 Drawing Sheets

FIG. 8
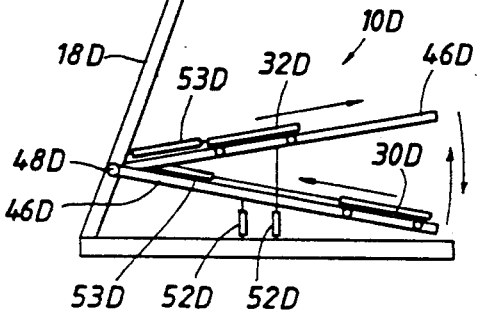
FIG. 9
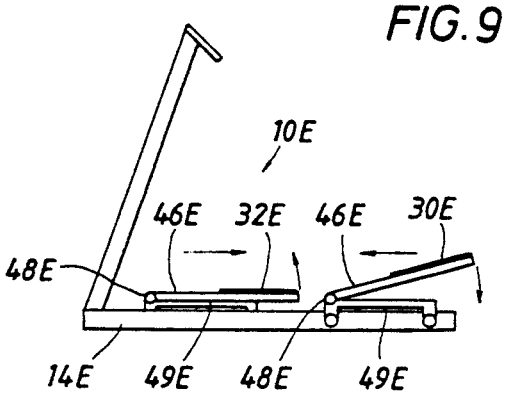
FIG. 10
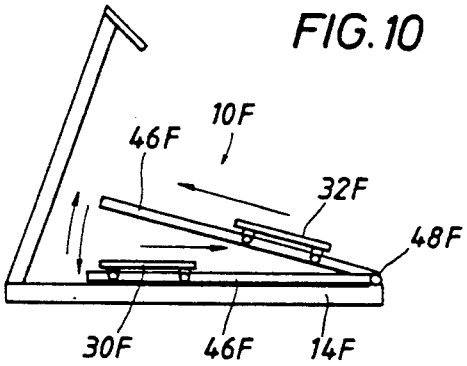
FIG. 11
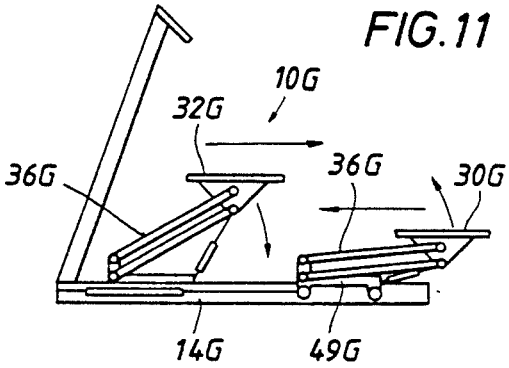
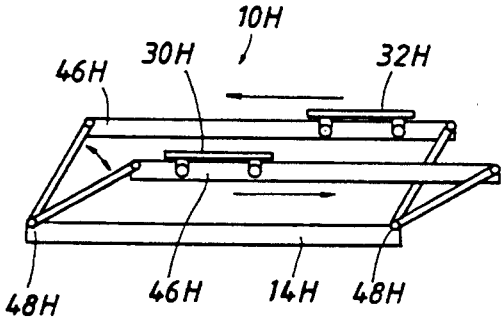
FIG. 12
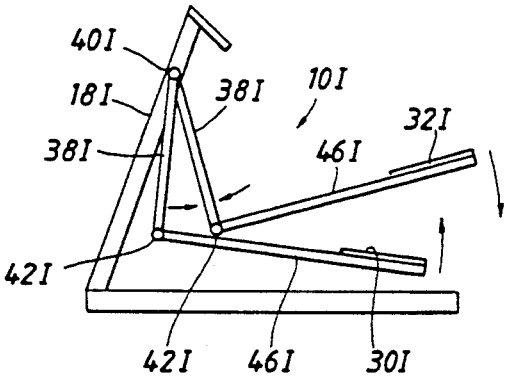
FIG. 13

EXERCISE DEVICE

BACKGROUND OF THE INVENTION

1. Field of the Invention

This invention relates generally to an exercise device. More particularly, the invention concerns an exercise device permitting a user to perform alternatively a stair stepping exercise or a cross country skiing exercise, or simultaneously to perform a stair stepping exercise and a cross country skiing exercise.

2. Description of Prior Art

Heretofore, various exercise devices have been provided to permit a user to perform a stair stepping exercise which simulates the climbing of stairs. Also, various exercise devices have been provided to permit a user to perform a cross country skiing exercise which simulates cross country skiing. However, none of the exercise devices heretofore have permitted in a single exercise machine, the simultaneous performance of a stair stepping exercise and a cross country skiing exercise. No prior exercise device has allowed a user to change the exercise he is doing while on the machine from stair climbing to cross country skiing to a bicycle-like motion to a backward walk motion, all without mechanical adjustment of the machine.

For example, U.S. Pat. No. 3,970,302 dated Jul. 20, 1976, shows an exercise device in which a pair of foot supports are mounted for movement along an inclined track to simulate stair climbing. A pair of shock absorbers connected to the foot supports resist downward movement resulting from a downward force exerted by the feet of a user and provide upward return movement of the foot supports to a predetermined position. There is no showing of an exercise movement simulating cross country skiing.

U.S. Pat. No. 4,685,666 dated Aug. 11, 1987, likewise shows an exercise device to simulate a climbing or stair stepping motion, but such exercise device does not provide a cross country skiing exercise.

U.S. Pat. No. 4,733,858 dated Mar. 29, 1988, shows a multi-purpose exercise device which may be utilized to perform various exercises. The device is used in a first position to practice climbing such as climbing steps. The device is adjusted to a second position to simulate a skating motion. There is no provision for performing a climbing exercise and a skating exercise simultaneously with the device remaining in one position.

U.S. Pat. No. 5,000,442 dated Mar. 19, 1990, shows a cross country ski simulator in which foot supports are mounted for generally horizontal back and forth movement with manually gripped handles controlling the movement of the foot supports and providing a resistance to the movement of the foot supports. Such ski simulator does not provide a simulated climbing or stair stepping exercise performed simultaneously with the cross country skiing exercise.

Identification of Objects of the Invention

It is an object of this invention to provide such an exercise device having a pair of foot supports movable in a generally vertical direction in a stair stepping exercise and movable simultaneously in a generally horizontal direction in a cross country skiing exercise.

A further object of this invention is to provide an exercise device having a pair of foot supports thereon which are mounted for simultaneous movement in combined horizontal and vertical directions while the foot supports remain in a horizontal plane.

An additional object of the invention is to provide an exercise device having a pair of foot supports mounted for combined generally vertical and horizontal movements with a force resisting member for each foot support in each direction.

SUMMARY

The invention is directed to an exercise machine or device which permits a user standing on foot supports to perform simultaneously a stair stepping or climbing exercise and a cross country skiing or skating exercise. The machine also permits alternative climbing or skiing exercises. The exercise machine includes a pair of foot supports on which the user stands to perform exercises. One preferred embodiment of the exercise machine includes a fixed support including a base and an upwardly extending support member. A linkage extends in a generally vertical direction between the fixed support and the foot supports.

Each foot support is operationally connected to force resisting means including a force resisting member for resisting downward movement of the foot support and, if desired, a separate force resisting member for resisting generally horizontal movement of the foot support. In preferred embodiments of the invention, the foot supports extend in a horizontal plane and remain in a horizontal plane during the entire exercise movement but are linked to the support member in a manner to permit exercise simulations as indicated above. The linkages between the support member and the foot supports may include four bar or parallelogram linkages.

In another preferred embodiment, a pair of horizontal support rails serves to support vertically and guide horizontally a pair of shuttle cars disposed thereon. Foot supports are pivotally linked to the shuttle cars. A force resistance means is connected between the foot support and each of the shuttle cars. In operation the foot supports may pivot with resistance with respect to the shuttle cars to produce a generally up and down motion similar to stair climbing. When a user stands on the foot supports, cross country skiing motion by such user is accommodated by reciprocating motion of the shuttle cars on the support rails. Simultaneous stair climbing and cross country skiing may be performed.

BRIEF DESCRIPTION OF THE DRAWINGS

The objects, advantages and features of the invention will become more apparent by reference to the drawings which are appended hereto and wherein like numerals indicate like elements and wherein an illustrative embodiment of the invention is shown, of which:

FIGS. 8–13 are schematic views of other various embodiments of the exercise device of this invention in which foot supports are mounted for movement in a generally vertical direction for a stair stepping exercise and for simultaneous or single movement in a generally horizontal direction for a cross country ski exercise.

DESCRIPTION OF THE INVENTION

Figure 1:
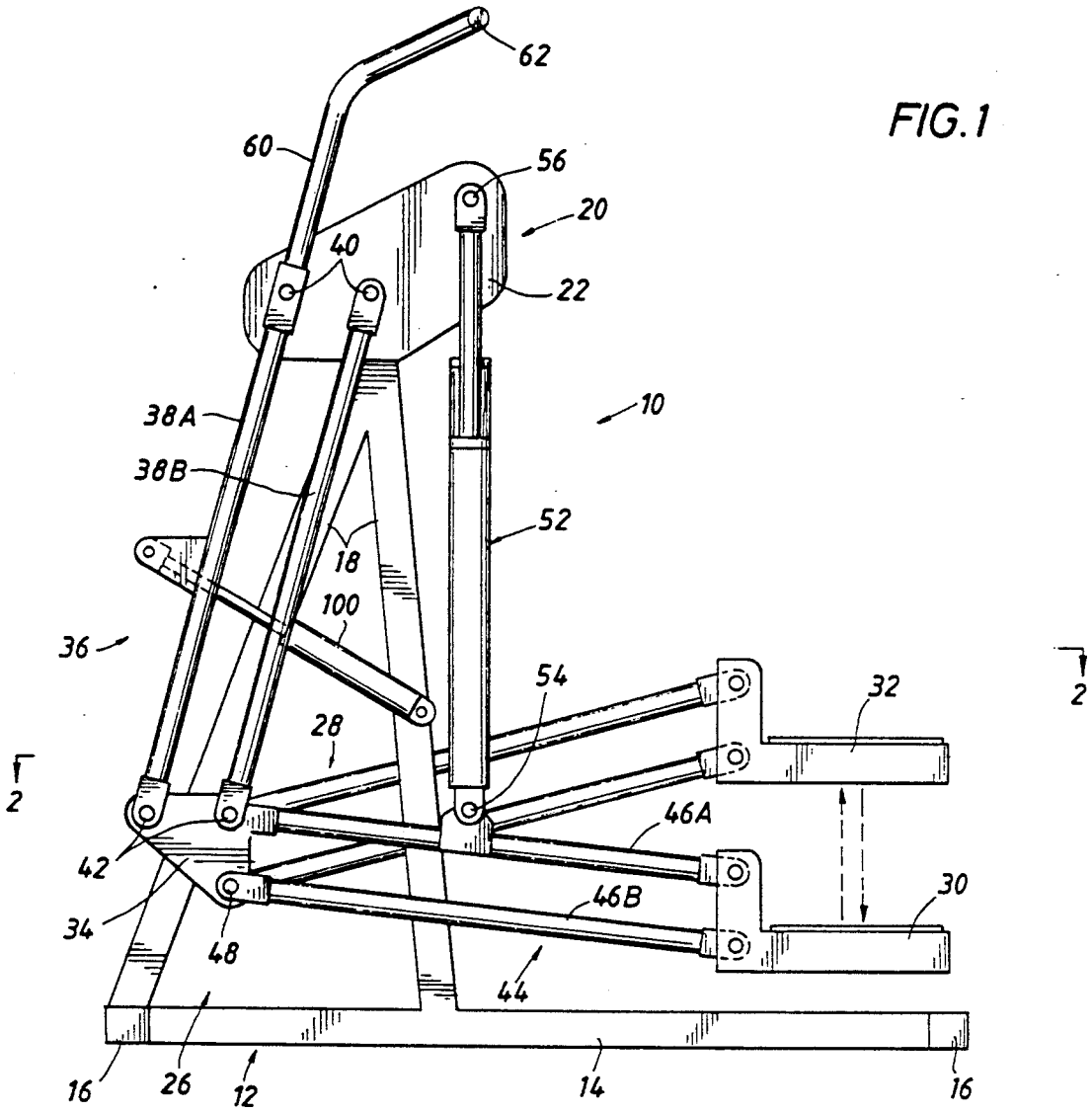
FIG. 1 is a side elevation of an embodiment of the exercise device of this invention for a combined stair stepping exercise and a cross country skiing exercise in which a fluid cylinder resists up and down motion of foot supports in the climbing mode and acts as a link in the support between the frame and the supports to enable skiing motion.
Figure 2:
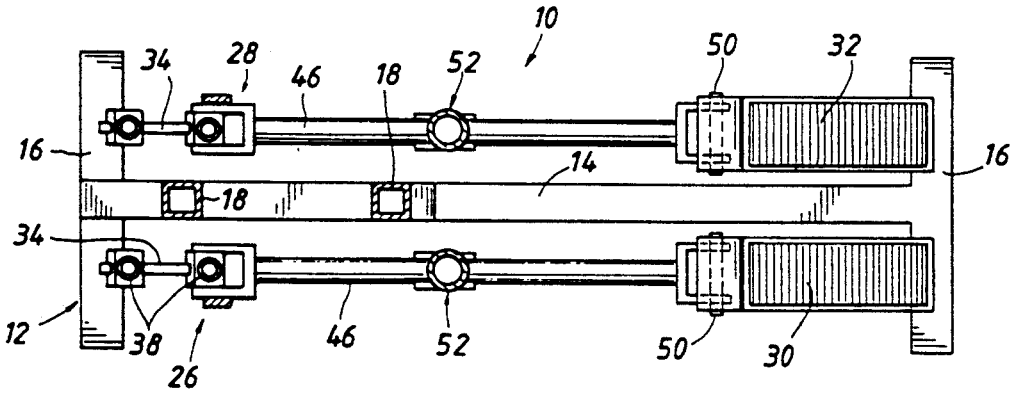
FIG. 2 is a plan view of the exercise device of FIG. 1 taken generally along the line 2—2 of FIG. 1.

Referring now to the drawings showing the embodiment of FIGS. 1–4, the exercise device generally indicated at 10 has a fixed support frame indicated generally at 12. Fixed support frame 12 includes a base support member 14 having end frame members 16 connected thereto and adapted for support by a floor. Upwardly extending frame member 18 supports an upper mounting head generally indicated at 20. Mounting head 20 includes a pair of opposed plates or side support members 22. A control panel 24 is provided between support members 22 for visually displaying performance data and the like as may be desired.

Linkage support frames 26 and 28 are pivotally supported from opposed side support members 22. Frames 26 and 28 include multiple pivoted links. Linkage support frame 26 includes a pivoted foot support 30. Linkage support frame 28 includes a pivoted foot support 32. The foot support 30 supports the left foot of a user; foot support 32 supports the right foot of a user.

Linkage support frames 26 and 28 are both shown in FIGS. 1–4, but only support frame 26 is described in detail, because support frame 28 is generally identical to support frame 26. Linkage support frame 26 includes a lower connecting plate or bracket 34. A four bar or parallelogram linkage generally indicated at 36 extends in a generally vertical direction between side support member 22 and connecting plate 34. Linkage 36 includes a pair of links 38A, 38B pivotally mounted at 40 to side support member 22 at their upper ends and pivotally connected at 42 to connecting plate 34 at their lower ends. A four bar or parallelogram linkage 44 extends in a generally horizontal direction between connecting plate 34 and foot support 30. The four bar linkage 44 includes a pair of links 46A, 46B pivotally connected at 48 to connecting plate 34 and pivotally connected at 50 to foot support 30.

Downward movement of foot support 30 is resisted by fluid cylinder 52 which is pivotally mounted at its lower end at 54 to upper link 46A of linkage 44 and pivotally mounted at its upper end at 56 to side support member 20. Fluid cylinder 52 cushions the downward movement of foot support 30 from the weight of the user thereon. Cylinder 52 is preferably a combined damping mechanism and spring. Upon release of the weight of the user the spring of cylinder 52 returns foot support 30 to its upper position. The spring loading may be manually adjusted for determining in the return movement. The resistance to the downward motion of foot support 30 from fluid cylinder 52 increases with downward velocity due to the damping mechanism of cylinder 52.

Operation in the stair climbing mode

FIG. 1 illustrates the condition of the exercise machine 10 in the stair climbing mode where the left foot of a user has pushed foot support 30 to a downward position. Natural action of the user takes force off of foot support 32 and it rises to the position shown under the upward spring force of a right hand side fluid cylinder 52.

For a solely stair stepping exercise, a user may wish to support himself by holding on to support plates 22 or to an auxiliary stationary bar (not shown) arranged for safety and stability during such exercise. Such bar may be fastened to base support member 14.

At the lower position shown for foot support 30, the fluid cylinder 52 completely "strokes out" such that fluid cylinder acts as a pivoted link between top support plate 22 and link 46A of linkage 44. Accordingly, in order to shift into a purely skiing exercise, the user stands on both foot supports 30 and 32 such that both of their fluid cylinders completely "stroke out" and the machine 10 is ready for horizontal skiing exercise.

Handles for skiing exercise

Figure 3:
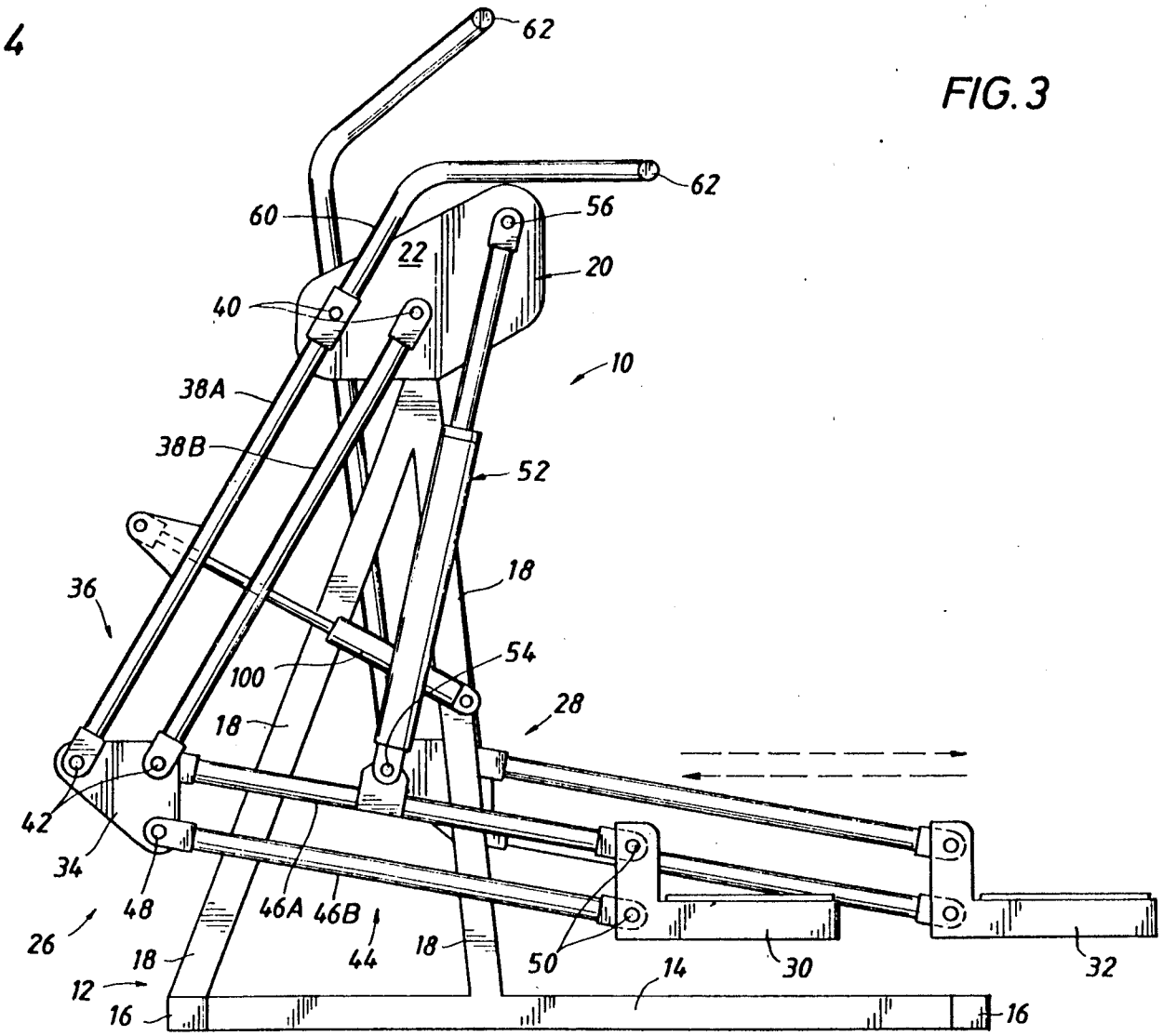
FIG. 3 is a side elevation of the exercise device similar to FIG. 1 but showing the foot supports moveable in a generally horizontal direction to simulate cross country ski motion.
Figure 4:
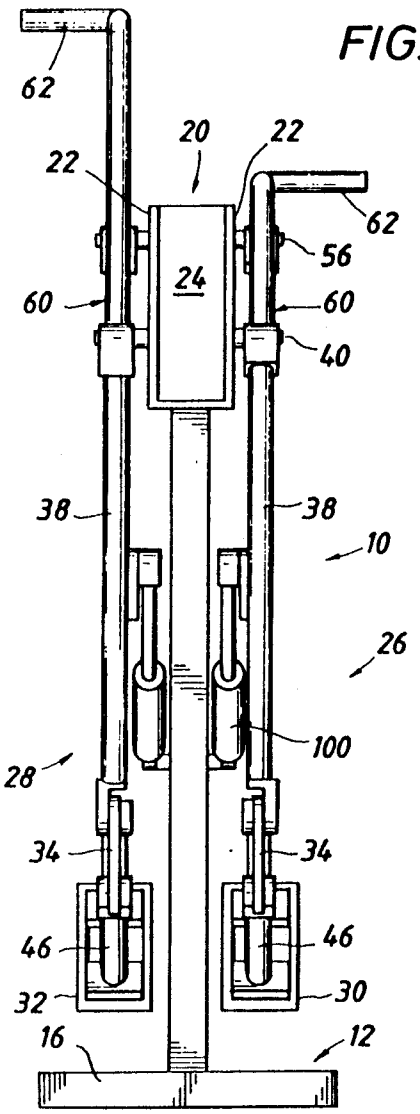
FIG. 4 is a front elevation of the exercise device shown in FIG. 3.

Left and right handles 60 are provided with upper hand grips 62 to aid a user when the machine is used in the skiing mode. FIGS. 1, 3 and 4 illustrate the preferred design of attaching handles to the outer link 38A of four bar linkage 36. Handles 60 may be fixed to link 38A by welding or other means such as screws or nuts and bolts. If desired, a force resisting means such as a spring and damper cylinder 100 may be placed between handle 60 and frame member 18 to resist backward and forward motion of the foot supports 30, 32. (Other force resisting means useful in the exercise machine art may be substituted for cylinder 100.)

Such force resisting means 100 may not be needed in that the very act of a user shifting his weight in a forward and backward motion may offer sufficient exercise to not require further force resisting means. For that reason, fluid cylinder 100 is shown in dashed lines to indicate that it may be installed when desired, or alternatively that it might not be necessary for proper skiing simulation. Of course, another fluid cylinder 100 (or other force resisting means) should be installed on the right-hand side between link 38A and frame member 18. Either the skiing mode or the stepping mode may have a mechanism to provide dependent operation between the left and right foot supports. Such mechanism may include a cable and pulley arrangement connected between the right and left linkages which causes the left foot support to move upwardly when the right foot support is forced downwardly and vice versa. A similar mechanism may be provided for forward and backward movement of the foot supports.

Design of linkages to allow horizontal movement of foot supports

As best illustrated in FIG. 3, foot supports 30 and 32 may be moved in substantially horizontal forward and rearward direction while being suspended from mounting head 20 by linkage 26. In such skiing mode, the fluid cylinders are completely "stroked out" and serve as an intermediate link between mounting head 20 and arm 46A of link 44.

The linkage 36 is a four bar pivoted linkage between head 20 and connecting plate 34. The linkage 44 is a four bar pivoted linkage between connecting plate 34 and foot support 30. (The right-hand side has similar linkages to foot support 32). The stroked out cylinder 52 forms a pivoted linkage between mounting head 20 and linkage 44. Such stroked out cylinder 52 forms still a third four bar linkage with head 20 and links 36 and 44. By appropriate adjustment of the lengths of links 36, 44 and stroked out cylinder 52 and by appropriate connection placement of cylinder 52 at head 20 and link 46A, the foot supports 30 and 32 may be constrained to move in a substantially horizontal backward and forward position, all the while being suspended from head 20 and requiring no connection on a track or the like.

Operation in the skiing mode

A user stands on both foot supports 30 and 32 to completely stroke out the fluid cylinders 52. The user then begins a shuffling skiing type motion while holding left and right handles 62. (Such motion is also similar to skating.) As the left hand foot support 30 moves forward, the left handle 62 moves rearward and up because of its connection to link 38A. As the left hand foot support 30 moves rearward, the left handle 62 moves forward and down. Such handles simulate the motion of ski poles manipulated by an actual skier.

Operation in multiple modes

The exercise machine 10 of FIGS. 1–4 may be operated in a mixed mode so that a combination of stair stepping and skiing motion may be simulated. In a forward direction, running, walking, or cycling type motions may be simulated. Such running motion is simulated (similar to that of a treadmill) without any impact at all on the user's knees, hips or feet. Reverse running motion may also be simulated.

Alternative embodiments

Figure 5:
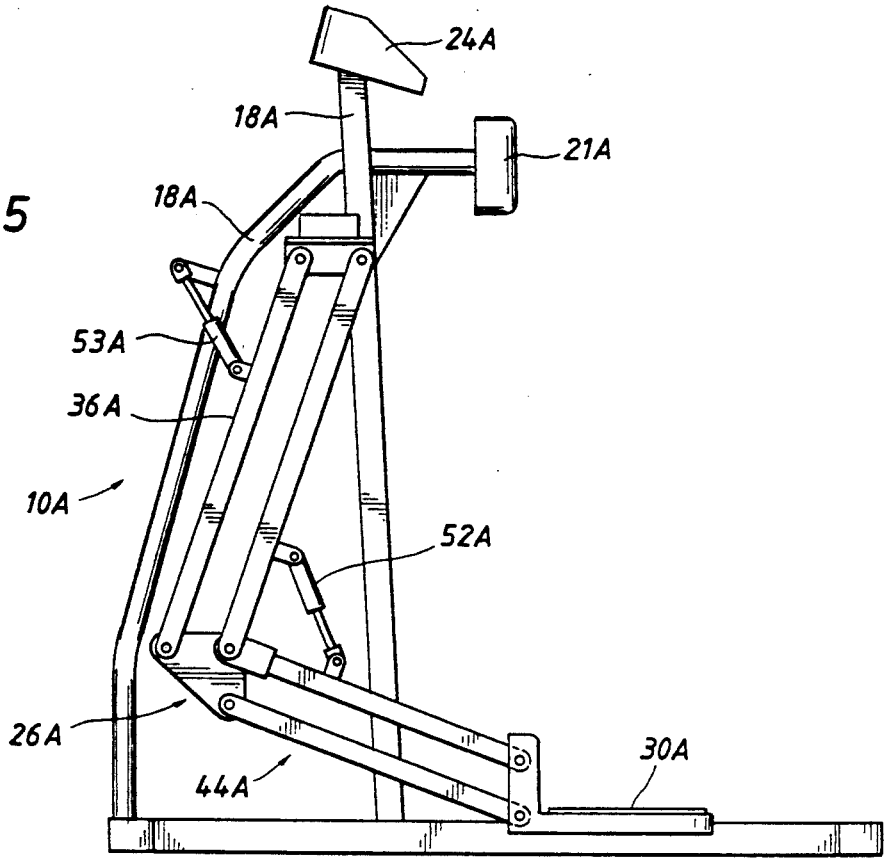
FIG. 5 is a side elevation of an alternative embodiment of the exercise device of this invention in which fluid cylinders are provided for resisting the movement of the foot supports in a generally horizontal direction and for resisting the movements to foot supports in a generally vertical direction, with four bar linkages maintaining the foot supports in a generally horizontal plane.

Referring to FIG. 5, an alternative exercise device indicated at 10A is shown schematically with linkage support 26A including an upper four bar linkage 36A and a lower four bar linkage 44A. (Only the left-hand side of the exercise device is illustrated. A similar right-hand side of the machine is provided, but it is not illustrated here, for simplicity.) A foot support 30A is mounted on one end of four bar linkage 44A. Resistance to movement of foot support 30A in a generally vertical direction is provided by a fluid cylinder 52A connected between lower four bar linkage 44A and upper four bar linkage 36A. Resistance to generally horizontal movement of foot support 30A may be provided (if desired) by fluid cylinder 53A extending between four bar linkage 36A and upright frame member 18A. An abdominal pad 21A is secured to fixed support frame member 18A to support the abdomen of a user. A control box 24A is mounted on the upper end of fixed support frame member 18A to provide to the user a visual observation of his performance from sensors (not shown) mounted on the machine. No manually operated handles are provided in the embodiment of FIG. 5, although such handles, similar to those of FIGS. 1–4 could be provided if desired.

Figure 6:
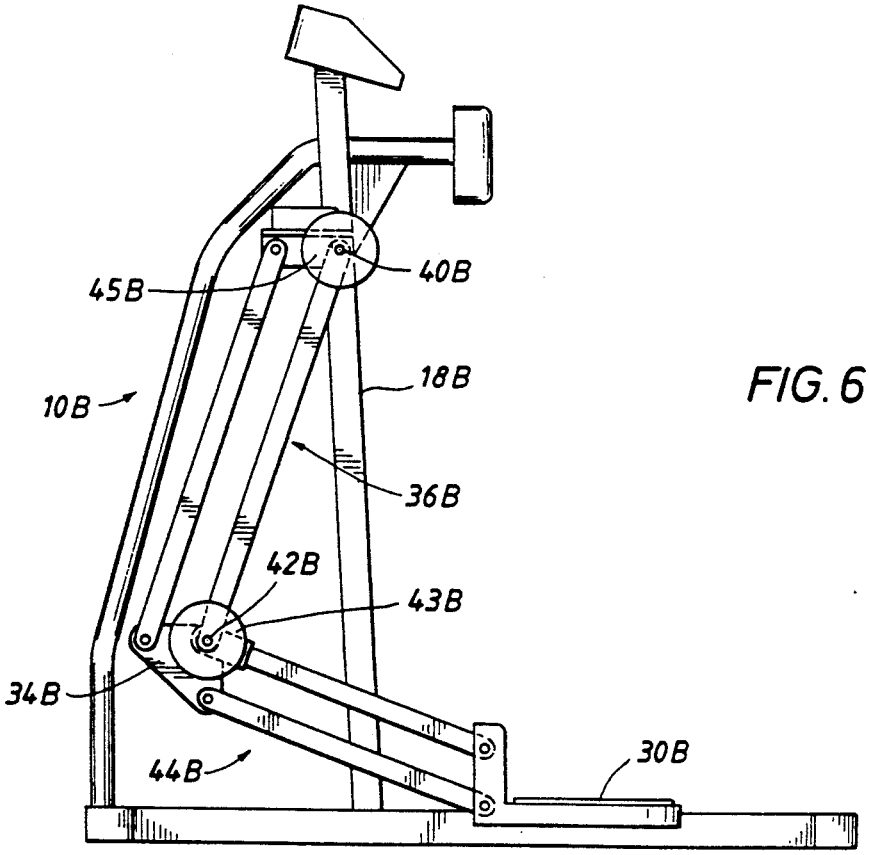
FIG. 6 is a side elevation of another alternative embodiment of the exercise device of the present invention utilizing servo motors for controlling the movement of the foot supports without the use of a fluid cylinder to produce foot support movement in a generally horizontal direction and in a generally vertical direction.

Another embodiment of the exercise device of this invention is illustrated at 10B of FIG. 6. It is similar to the exercise device 10A of FIG. 5 except in regard to the force resisting members resisting the vertical and horizontal movements of foot support 30B. Four bar linkages 36B and 44B are provided. A connecting plate 34B includes a pivot 42B for linkages 36B and 44B. Pivot 40B is provided for four bar linkage 36B mounted on fixed vertical support frame member 18B. A servo motor 43B is provided to control the pivotal movement of pivot axis 42B. Another servo motor 45B is provided to control the pivotal motion of pivot 40B. Thus, servo motor 43B may be used to provide a resisted force to the generally vertical movement of foot support 30B. Servo motor 45B may be used to resist the generally horizontal movement of foot support 30B. Servo motors 43B and 45B may be adjusted to provide the desired resistance. Alternatively, servo motors may provide a programmed motion, either stair climbing or skiing or any combination of both motions for physical rehabilitation of a patient.

Figure 7:
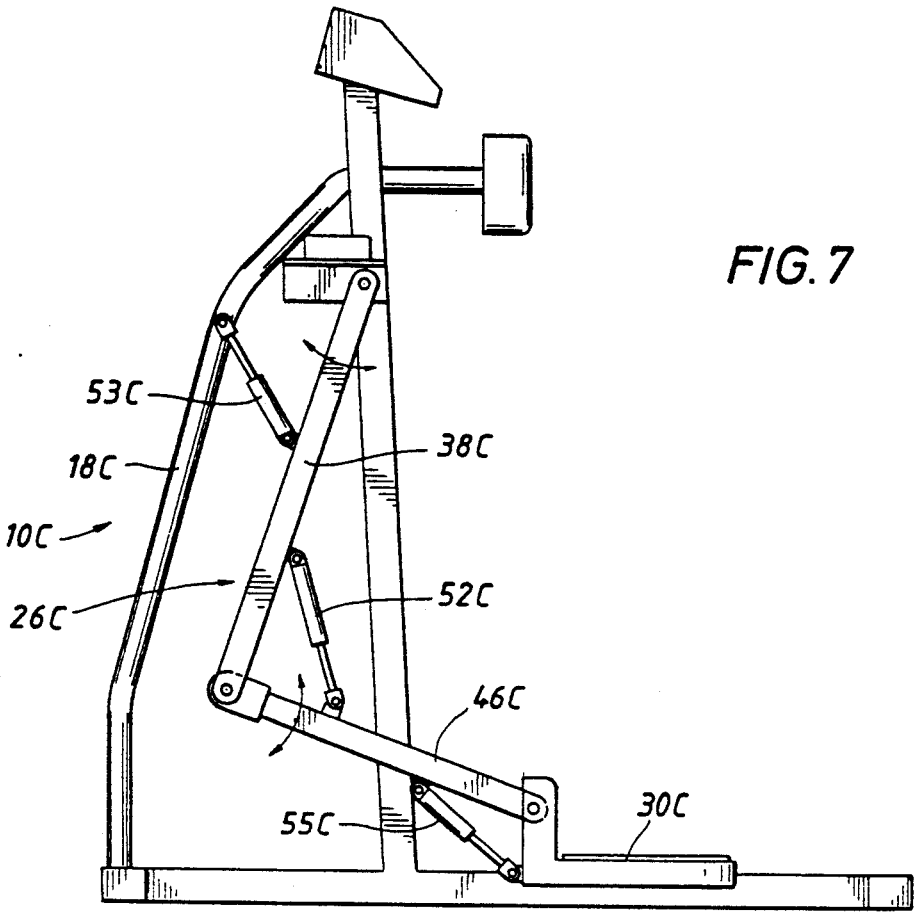
FIG. 7 is a side elevation of another alternative embodiment of the exercise device of this invention similar to the embodiment of FIG. 6 but eliminating certain four bar links while utilizing fluid cylinders for resisting the horizontal and vertical movements of the foot support and having a fluid cylinder connected to the foot support for maintaining the foot support in a generally horizontal plane.

Referring now to FIG. 7, an exercise device of for this invention is shown at 10C. Linkage support frame 26C includes an upper link 38C and a lower link 46C. An upper fluid cylinder 53C extends between link 38C and fixed support frame member 18C to control the horizontal movement of foot support 30C. Fluid cylinder 52C controls the generally vertical movement of foot support 30C and is connected between links 38C and 46C. To maintain foot support 30C in a generally horizontal plane, fluid cylinder 55C is pivotally mounted between link 46C and foot support 30C. The providing of a separate fluid cylinder 55C to maintain foot support 30C in a generally horizontal plane eliminates the necessity of having four bar linkages as in the embodiments shown in FIGS. 1–4, FIG. 5, and FIG. 6. Other satisfactory force resisting devices could be provided such as servo motors, for example.

FIGS. 8–13 are schematic views of further embodiments of the exercise device in accordance with the present invention in which foot supports 32 (D,E,F,G,-H,I) are moveable simultaneously in a stair stepping exercise and in a cross country skiing exercise with a force resisting device for resisting generally vertical movement for the stair stepping exercise and a separate force resisting device for resisting generally horizontal movement for the cross country skiing exercise. For example, as shown in FIG. 8, exercise device 10D has foot supports 30D and 32D mounted for sliding movement on links 46D which are pivotally mounted at 48D to fixed frame member 18D. To resist generally horizontal movement of foot supports 30D and 32D, force resisting devices 53D may be provided if desired. To resist generally vertical movement of foot supports 30D and 32D, force resisting devices 52D are provided. Such force resisting devices are similar to those of FIGS. 1–4.

The exercise machines of FIGS. 9–13 are not shown with force resisting devices of members thereon. However, it should be understood that force resisting devices similar to those in the embodiment of FIG. 8 would be used for the embodiments of FIGS. 9–13. Referring to FIG. 9, foot supports 30E and 32E are mounted on link arms 46E which, in turn, are pivotally mounted at 48E to carriages 49E which are mounted for horizontal movement along fixed base frame member 14E.

FIG. 10 shows an embodiment in which foot supports 30F and 32F are mounted for sliding movement along link arms 46F which, in turn, are pivotally mounted at 48F to base frame member 14F. FIG. 11 shows an alternative preferred embodiment 10G of the invention having foot supports 30G and 32G mounted on four bar linkages 36G which, in turn, are pivotally mounted on a shuttle car or carriage 49G for horizontal movement along base frame member 14G. A more detailed description of the embodiment of FIG. 11 is described below in conjunction with FIG. 14.

FIG. 12 shows exercise device 10H having foot supports 30H and 32H mounted for sliding movement along an upper link 46H of a four bar linkage which is pivotally connected by rear and forward pivots at 48H to a base support member 14H. FIG. 13 shows an embodiment 10I in which foot supports 30I and 32I are mounted on links 46I which are pivotally connected at 42I to links 38I. Links 38I are pivotally connected at 40I to fixed vertical support frame member 18I.

Alternative low profile embodiment of the invention

Figure 14:
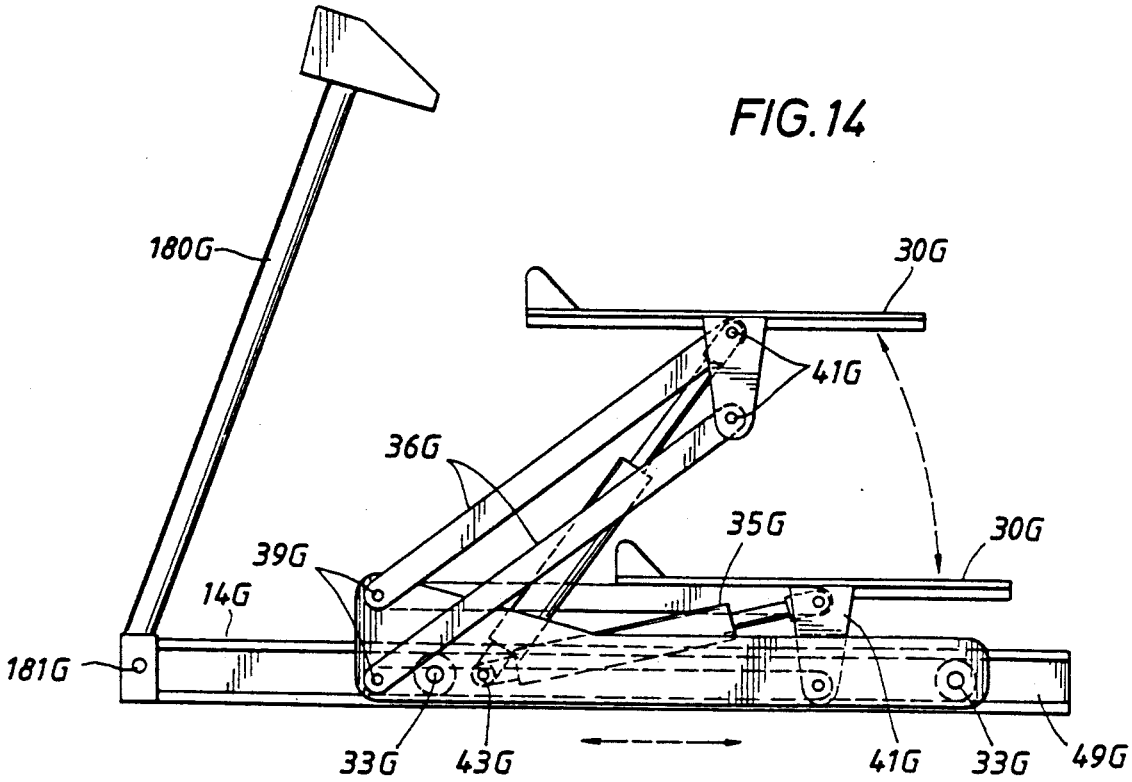
FIG. 14 is a detailed illustration of an alternative low profile embodiment of the invention.

FIG. 14 shows in more detail an alternative preferred embodiment of the invention in which a pair of rails 14G vertically support and horizontally guide a pair of foot supports 30G. In the view of FIG. 14, only one support is shown in its up and down positions, but an identical foot support and rail is placed on the other side of the ones shown.

Rollers 33G are secured to shuttle cars 49G and fit within a guide groove of rails 49G. Brackets 41G are secured between foot supports 30G and shuttle car 49G. Accordingly, when a user stands on foot supports 30G and alternately moves his legs in forward and backward directions, shuttle carriage 49G moves forward and backward as it is guided by rollers 33G within guide grooves of rails 14G.

Links 36G are connected by pivots 37G to bracket 41G and by pivots 39G to the forward end of shuttle car 49G. Links 36G are preferably parallel to each other so as to create a four bar linkage between the foot supports 30G and the shuttle cars 49G. A damper 35G is connected between bracket 41G at one of the pivots 37G to another pivot 43G on shuttle car 49G. Such damper increasingly resists downward motion as a function of increasing downward velocity.

Such dampers may be adjustable to provide variable resistance. The damper 35G may also include a spring to bring foot support 30G to an upward position when the user is not standing on it. The damper and the spring may be separate items, but preferably they are in an integral "shock absorber" as illustrated in FIG. 14. Alternatively, a spring return may not be desired for independent action of each foot support 30G; in that case, left and right foot supports are interconnected by means of a pulley arrangement or the like such that as the left foot support is forced downwardly, the right foot support moves upwardly and vice versa.

The alternative preferred embodiment of FIGS. 11 and 14 allows the same simultaneous stair climbing and cross country skiing exercises as that shown in the embodiment of FIGS. 1–4. It has the advantage of a lower vertical profile, especially where support 180G may be folded down; with the result that the exercise device may be stored in less vertical space.

Alternative arrangement for poles for stepping exercise

Figure 15:
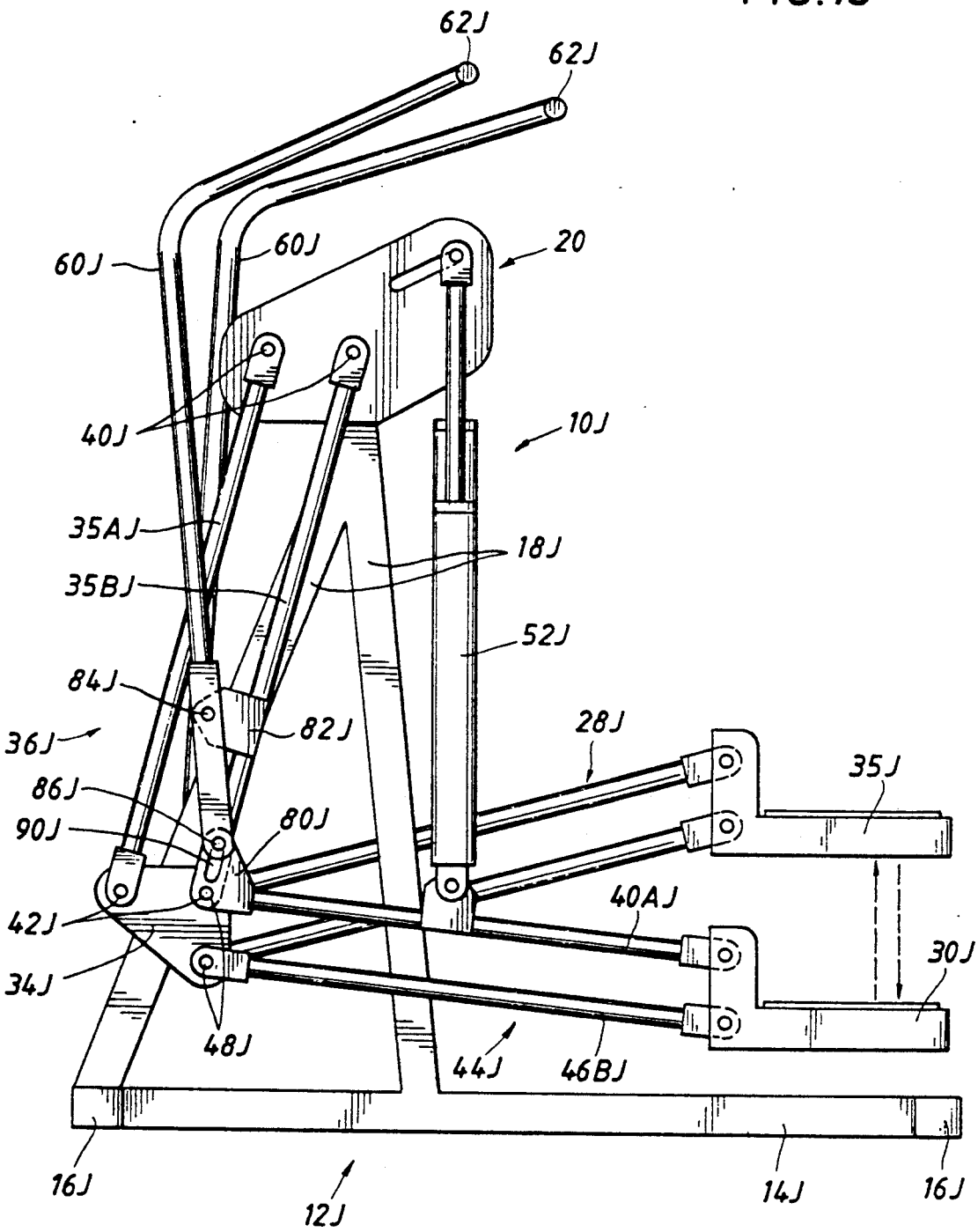
FIG. 15 illustrates an alternative embodiment for connection of handles to the exercise device for a stair climbing exercise.

FIG. 15 illustrates an alternative embodiment of the invention of an exercise device 10J similar in arrangement to that of FIGS. 1–4, but with an alternative connection of poles 60J to the linkage 36J which links foot supports 30J and 32J to support 20. The left hand pole 60J is connected by a pivot 84F to bracket 82 fastened to link 38BJ. Pole 60J includes a bar 86J secured for motion within slot 90J of bracket 80J which is pivoted to connecting plate 34. The right hand handle 60J is connected (the connection is not shown) in a corresponding way to link 38BJ on the right hand side of the exercise device 10J.

The alternative arrangement of poles 60J and their connections to links 38BJ enable them to move rearwardly when its associated foot support moves up and vice versa. With reference to FIG. 15, as support 30J moves up, link 46AJ pivots upwardly about pivot 42J causing bracket 80J to pivot counterclockwise. Such rotation of bracket 80J causes pole 60J to rotate clockwise about pivot 84J in bracket 82 while the end of pole 60J slides downwardly with its link 86J in slot 90J. Opposite motions occur when the foot support moves downwardly. The arrangement of the handles of FIG. 15 causes them to move in a sympathetic manner with the natural movement of human arms when climbing stairs. In other words, as a user's left foot pushes downwardly his left arm naturally rises and vice versa.

While preferred embodiments of the present invention have been illustrated in detail, it is apparent that modifications and adaptations of the preferred embodiment will occur to those skilled in the art. For example, although several embodiments of the invention have been illustrated it should be apparent to routineers in the art of exercise equipment design that other support structures than the floor support members of FIGS. 1–6 are possible. A wall support or even a support from an overhead structure could be used with the foot supports and linkages of the invention. It is to be expressly understood that such modifications and adaptations are within the spirit and scope of the present invention as set forth in the following claims.

What is claimed is:

1. An exercise device for simultaneously permitting a combined stair stepping exercise in a generally vertical direction and a cross country skiing exercise in a generally horizontal direction, said exercise device comprising:

support means including a base support;

a pair of spaced foot supports for supporting the feet of a user in a generally upright position;

linkage means connected between said foot supports and said support means for mounting said foot supports for movement in either a generally vertical movement simulating a stair stepping exercise or a generally horizontal movement simulating a horizontal skiing exercise or simultaneously in a stair stepping exercise and a horizontal skiing exercise; and force resisting means for resisting movement of said foot supports.

2. The exercise device of claim 1 wherein said force resisting means is operatively connected to said linkage means to resist movement of said foot supports.

3. An exercise device as set forth in claim 1 wherein said force resisting means comprises separate force resisting means for each of said foot supports.

4. An exercise device as set forth in claim 3 wherein said separate force resisting means for each of said foot supports comprises a force resisting device to resist downward movement of the associated foot support.

5. An exercise device as set forth in claim 1 further comprising a handle operatively connected to the associated foot support and adapted to be gripped manually by a user during said horizontal skiing exercise.

6. An exercise device as set forth in claim 1 wherein said linkage means includes for each foot support a first linkage having an associated foot support on one end of thereof and a second linkage pivotally mounted at its lower end to said first linkage adjacent an opposite end of said first link.

7. An exercise device as set forth in claim 6 wherein said first linkage comprises a four bar linkage including a pair of parallel links.

8. An exercise device as set forth in claim 7 wherein said second linkage comprises a four bar linkage including a pair of parallel links.

9. An exercise device as set forth in claim 6 wherein said second linkage is pivotally mounted to said support means adjacent its upper end and the pivotal connection between said first linkage and said second linkage glides back and forth in a horizontal skiing exercise relative to said support means during operation of said exercise device.

10. An exercise device as set forth in claim 2 wherein said linkage means includes a generally horizontal linkage connected to said foot support, and a generally vertical linkage pivotally connected at its lower end to said horizontal linkage and pivotally connected at its upper end to said support means; and said force resisting means comprises a force resisting device operatively connected to said generally horizontal linkage to resist downward movement thereof.

11. The exercise device of claim 10 wherein said force resisting device is a fluid cylinder having a damper and spring to resist downward force on said foot support.

12. The exercise device of claim 11 wherein said fluid cylinder is operatively arranged between said support means and said generally horizontal linkage so that when said fluid cylinder is fully stroked out due to a user's downward force on it, said fluid cylinder acts as a link in a support mechanism between said foot support and said support means to produce a substantially horizontal back and forth movement of said foot support as a user simulates a skiing movement.

13. An exercise device for providing a stair stepping exercise or providing a horizontal skiing exercise or for simultaneously permitting a combined stair stepping exercise in a generally vertical direction and a cross country skiing exercise in a generally horizontal direction, said exercise device comprising:

support means including a base support;

a pair of spaced foot supports for supporting the feet of a user in a generally upright position;

linkage means mounting said spaced foot supports for separate individual movement in a generally vertical direction or for separate individual movement in a generally horizontal direction of for simultaneous separate individual movement in a combination of vertical and horizontal directions; and resistance means operatively connected between said foot supports and said support means for separately resisting the downward movement of each of said foot supports upon a downward force exerted against an associated foot support and returning said foot support to a rest position upon release of said downward force.

14. An exercise device as set forth in claim 13 wherein said linkage means includes first linkage means connected at one end to said foot supports, and second linkage means pivotally connected to said first linkage means adjacent the other end thereof whereby the pivotal connection between said first and second linkage means glides back and forth during operation of the exercise device from downward forces exerted by the feet of a user on said foot supports.

15. An exercise device for providing a stair stepping exercise or providing a horizontal skiing exercise or for simultaneously permitting a stair stepping exercise and a cross country skiing exercise comprising:

support means including a base support and an upwardly extending fixed support member;

a pair of spaced foot supports adapted to support the feet of a user in a generally upright position;

first linkage means pivotally connected at one end to said foot supports;

second linkage means extending in an upward direction and having a lower end pivotally connected adjacent the other end of said first linkage means to form a floating connection between said first linkage means and said second linkage means;

means pivotally connecting said second linkage means adjacent its upper end to said support means; and means operatively connected to said first linkage means resisting downward movement of said foot rests when the user is supported on said foot rests.

16. An exercise device as set forth in claim 15 wherein said means resisting downward movement of said foot supports comprise fluid cylinder means connected to said first linkage means.

17. An exercise device as set forth in claim 15 wherein said means resisting movement of said foot supports comprises resistance means connected to the pivot connection between said first linkage means and said second linkage means to resist pivotal movement therebetween.

18. An exercise device as set forth in claim 17 wherein said resistance means comprises a servo motor adapted to return said first linkage means and foot supports to a predetermined position when in a rest position.

19. An exercise device as set forth in claim 15 wherein said first linkage means comprises a parallelogram linkage including a pair of pivotally mounted links for each foot support.

20. An exercise as set forth in claim 19 wherein said second linkage means comprises a parallelogram linkage including a pair of pivotally mounted links.

21. An exercises devices as set forth in claim 15 wherein said first linkage means comprises a separate first linkage for each foot support, each first linkage being a four bar linkage connected to an associated foot support.

22. An exercise device as set forth in claim 21 wherein said second linkage means comprises a separate second linkage for each foot support, each second linkage being a four bar linkage connected to said associated first linkage.

23. An exercise device as set forth in claim 15 wherein a handle for each foot support has a lower end thereof operatively connected to said second linkage means for movement of an associated foot support in a generally horizontal direction; and said means resisting downward movement of said foot supports permits a generally vertical movement simultaneously with the movement thereof in a generally horizontal direction.

24. The exercise device for simultaneously permitting a stair stepping exercise and a cross country skiing exercise of claim 1 wherein said base support includes, a pair of horizontal support rails, a shuttle car pair, each car of said shuttle car pair corresponding to a foot support of said pair of foot supports, guide means for vertically supporting said cars with said rail pair and for horizontally guiding said cars to reciprocate horizontally, and said linkage means includes a linkage pair connecting each foot support of said foot support pair to a corresponding car of said shuttle car pair, each linkage of said linkage pair being pivoted at said foot support and at said corresponding car.

25. The exercise device of claim 24 wherein each linkage of said linkage pair comprises a four bar linkage including a pair of parallel links.

26. The exercise device of claim 24 wherein said force resisting means is a pair of shock absorbers with each shock absorber including a damper to resist downward force on said foot support, with each shock absorber secured between a foot support of said foot support pair and a corresponding shuttle car of said car pair.

27. The exercise device of claim 26 wherein each of said shock absorbers is adjustable whereby said damper may be adjusted to provide varying degrees of force resistance with respect to velocity of downward movement.

28. The exercise device of claim 26 wherein each of said shock absorbers further includes a spring to return a foot support to which it is secured to an upper position when a user is not forcing said foot support downward.

29. The exercise device of claim 26 further including means for causing one foot support to be forced upwardly in response to the downward motion of the other foot support of said foot support pair.

30. The exercise device for simultaneously permitting a combined stair stepping exercise in a generally vertical direction and a cross country skiing exercise in a generally horizontal direction of claim 1 further comprising;

means connecting a pole to said linkage means such that as a foot support moves generally upward, said pole moves generally clockwise in a forward and downward motion and vice versa.

* * * * *